United States Patent [19]

McKann

[11] 4,287,684

[45] Sep. 8, 1981

[54] THRESHOLD WITH ADJUSTABLE WEATHER SEAL

[75] Inventor: H. Smith McKann, Fredericksburg, Va.

[73] Assignee: General Products Company, Inc., Fredericksburg, Va.

[21] Appl. No.: 66,813

[22] Filed: Aug. 15, 1979

[51] Int. Cl.[3] ..... E06B 1/70

[52] U.S. Cl. ..... 49/468; 49/469

[58] Field of Search ..... 49/468, 469, 467

[56] References Cited

U.S. PATENT DOCUMENTS

| | | | |
|---|---|---|---|
| 352,745 | 11/1886 | Fuchs | 49/468 |
| 596,948 | 1/1898 | Seely | 49/468 |
| 2,839,796 | 6/1958 | Qnoss | 49/468 |
| 2,862,261 | 12/1958 | Qnoss | 49/468 |
| 2,880,476 | 4/1959 | Wahlfeld | 49/468 |
| 3,032,837 | 5/1962 | Ramsey | 49/505 |
| 3,374,579 | 3/1968 | Neff | 49/468 |
| 3,402,512 | 9/1968 | Peterson | 49/468 |
| 3,690,037 | 9/1972 | Kempel | 49/468 X |
| 3,900,967 | 8/1975 | Bursh et al. | 49/468 |
| 4,003,162 | 1/1977 | Britt | 49/468 |
| 4,165,325 | 5/1979 | McMullen et al. | 49/468 |

*Primary Examiner*—Kenneth Downey

*Attorney, Agent, or Firm*—Roylance, Abrams, Berdo & Farley

[57] ABSTRACT

A threshold having an adjustable elastomeric weather seal comprising a rigid hollow assembly fixedly interposed between a door and the floor, an elastomeric seal received in a recess in the hollow assembly and extending therefrom, and a compression mechanism located inside the hollow assembly for compressing the seal against a wall of the hollow assembly to vary the amount of the seal extending therefrom. The compression mechanism comprises an elongated channel member, a plurality of internally threaded annular members coupled to the channel member and a plurality of threaded rods received in the annular members and extending through apertures in one wall of the hollow assembly.

17 Claims, 2 Drawing Figures

THRESHOLD WITH ADJUSTABLE WEATHER SEAL

FIELD OF THE INVENTION

The present invention relates to thresholds for doors and more particularly relates to a threshold having an adjustable elastomeric weather seal.

BACKGROUND OF THE INVENTION

Threshold assemblies are known in the prior art which are received between the bottom of a door and the floor and which have vertically adjustable weather seals to account for misdimensioned doors or variations due to weather or use. However, there are numerous disadvantages in these prior art thresholds. For example, in U.S. Pat. No. 2,839,796 issued to Quoss on June 24, 1958, the weather seal is received in a recess in the threshold and is caused to bulge or arch upwardly by selective positioning an edge piece which is moved towards or away from the seal. A plurality of elongated slots formed in the edge piece receive a plurality of screws to adjustably position the edge piece, and therefore vary the vertical height of the seal. However, such an adjustable feature is not very firm and secure because the edge piece is exposed to foot contact and either a downward pressure on the seal, such as that caused by someone stepping on the seal, or kicking the edge piece as in normal use would tend to loosen the edge piece and therefore relax the seal.

In U.S. Pat. No. 3,900,967 issued to Bursk et al on Aug. 26, 1975, a threshold is disclosed in which there is an elastomeric seal having vertical adjustability. However, the support for this seal in the vertical direction relies on frictional engagement and does not appear very strong, so that stepping on the seal would tend to reduce the vertical height thereof, thereby diminishing its sealing effectiveness and negating any prior upward adjustment.

In U.S. Pat. No. 4,003,162, issued on Jan. 18, 1977 to Britt, the threshold is formed from two separate assemblies which have the elastomeric seal therebetween, the vertical height of the seal being variable upon relative movement of these two assemblies towards and away from each other. Thus, in order to vary the height of the seal, the entire threshold width must be varied.

In addition, many of these prior art devices, are extremely complicated, requiring costly materials and complex manufacturing procedures.

SUMMARY

Accordingly, it is a primary object of the present invention to provide a new and improved threshold with an adjustable weather seal which provides a positive and long lasting adjustment to the seal.

Another object of the present invention is to provide such a threshold in which the transverse width of the threshold is not modified upon adjustment of the vertical height of the seal.

Another object of the present invention is to provide such a threshold which is formed of a limited number of separate pieces and can be cheaply and quickly manufactured.

Another object of the present invention is to provide such a threshold which is firmly anchored to the floor and tends to reduce contamination from dirt of the interior parts of the threshold.

The foregoing objects are basically attained by providing a threshold having an adjustable weather seal, the combination comprising a rigid hollow assembly adapted to be fixedly interposed between a door and the floor, the assembly having an elongated recess, the assembly also having a first stationary member and a second stationary member spaced apart by a fixed dimension, the second stationary member defining one side of the recess; an elongated elastomeric seal received in the recess with a portion thereof extending above the assembly; and a compression mechanism, located inside the hollow assembly and coupled to the first stationary member, for compressing the seal against the second stationary member to vary the distance the seal extends from the assembly so that the seal contacts the bottom of the door.

In particular, the compression mechanism comprises an elongated channel member and a plurality of threaded rods which, upon rotation, adjust the vertical height of the seal.

Because of the use of the rigid hollow assembly of fixed lateral dimension, the width of the threshold does not vary upon adjustment of the seal's height. Because of the use of threaded rods to compress the seal, a very firm and positive adjustment is accomplished, which does not deteriorate when pressure is applied on the seal. In addition, the hollow assembly is formed from a single piece of sheet material so that manufacture of the threshold is simple and quickly accomplished. Moreover, the recess formed in the hollow assembly, which receives the seal, is closed by the channel member of the compression mechanism, thereby limiting contamination of the threshold's interior from dirt and other foreign objects. The entire threshold is easily secured to the floor by means of simple screws.

Other objects, advantages and salient features of the present invention will become apparent from the following detailed description which, taken in conjunction with the annexed drawings, discloses a preferred embodiment of the present invention.

DRAWINGS

Referring now to the drawings which form a part of this original disclosure:

FIG. 1 is a left side elevational view in section taken along lines 1—1 of FIG. 2 showing the apparatus in accordance with the present invention in a sealing mode; and FIG. 2 is a fragmentary front elevational view in partial vertical section showing the front of the apparatus illustrated in FIG. 1.

DETAILED DESCRIPTION OF THE INVENTION

Figure 1:
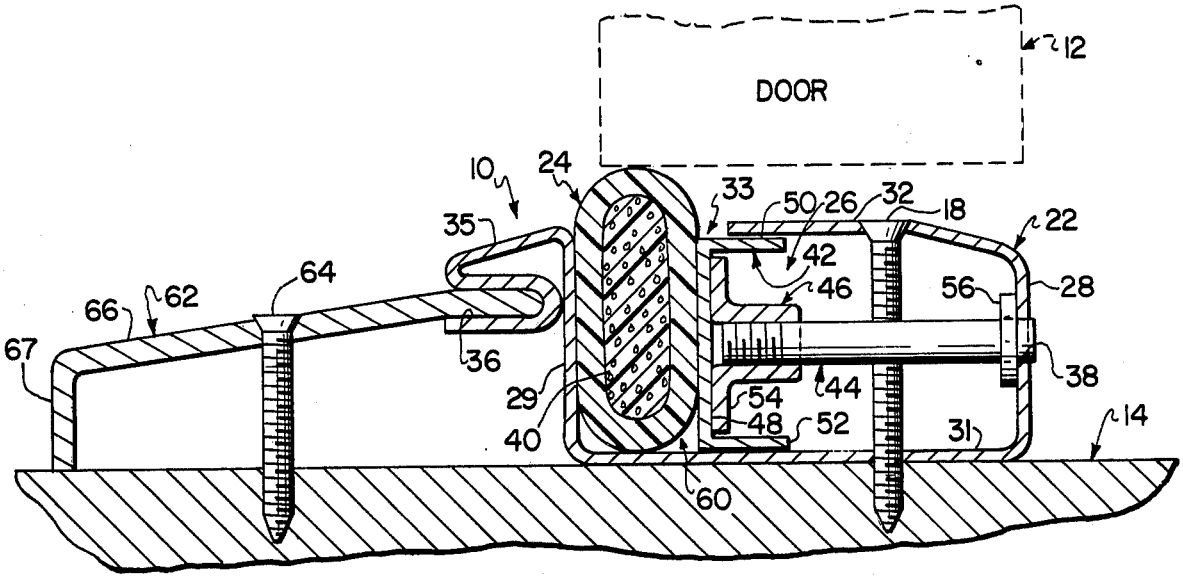
Figure 2:
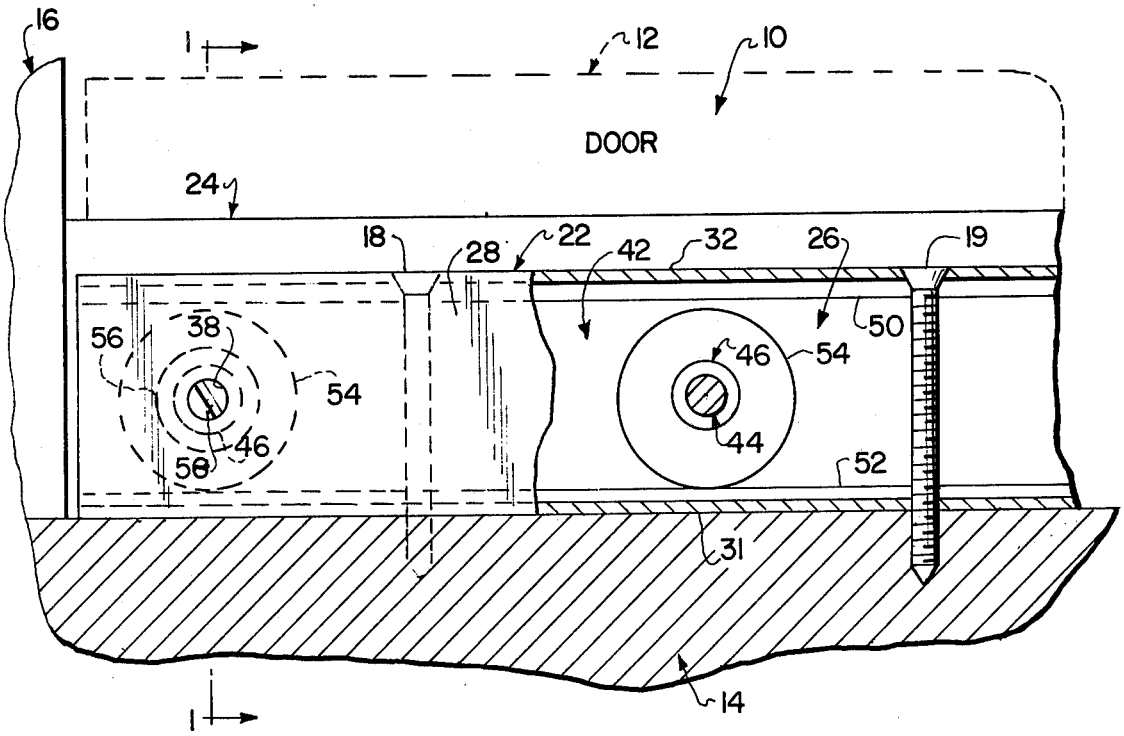

As seen in FIGS. 1 and 2, the threshold 10 in accordance with the present invention is interposed between the bottom of a door 12, a portion of which is shown in dashed lines, and the top of a floor 14. As seen in FIG. 2, a portion of a side frame 16 is illustrated resting on the floor 14 adjacent the door 12. In order for the seal portion of the present invention to be effective, it not only seals against the bottom of the door 12 but also has an end portion sealing against the side frame 16, to be described in more detail hereinafter.

The threshold 10 is fixedly located in the position between the bottom of the door 12 and the top of the floor 14 by means of a plurality of screws, screws 18 and 19 being shown by way of example in FIGS. 1 and 2. In addition, the threshold 10 can be maintained in this fixed position by means of screws or other fastening devices passing through side frames and being received in suitable mechanisms provided on the ends of the threshold 10. End fittings similar in shape to the extruded threshold members disclosed in co-pending patent application Ser. No. 939,193, filed on Sept. 5, 1978, in the name of the inventor herein and assigned to a common assignee, can be employed for this purpose.

As seen in FIG. 1, the threshold 10 comprises a rigid hollow assembly 22, an elastomeric seal 24 and a compression mechanism 26 for compressing the seal, the compression mechanism being located inside the hollow assembly 22 and a part of the seal extending above the assembly.

The rigid hollow assembly 22 is formed from a bent sheet of metal and comprises a substantially planar, vertically oriented front wall 28, a substantially planar, vertically oriented rear wall 29, a substantially horizontal top wall 30 and a substantially planar bottom wall 31. All of these walls are integrally formed from the single piece of sheet metal. The bottom wall 31 rests on the floor 14. The rear edge of the top wall 32 is spaced from the top edge of rear wall 29 to define a slot 33 therebetween. Suitable bores are formed in the top wall 32 and the bottom wall 31 so that screws 18 and 19 can be received therein to rigidly support the threshold 10 on the floor 14.

At the top of the rear wall 29 a rearwardly and downwardly extending flange 35 is integrally formed which flange has an outwardly opening U-shaped slot 36 formed at the bottom thereof.

The front wall 28 as seen in FIGS. 1 and 2 has a series of spaced, aligned apertures 38 formed therein, only one of which is actually shown. The top wall 32 has a front part downwardly sloping into the top of front wall 28.

The seal 24 is formed from elastomeric material and is tubular. Preferably, the seal is formed from rubber or plastic and can have a foamed polymeric material 40 filling the interior hollow cavity of the tubular seal. Most preferably, this polymeric material is located at least at opposite ends of the seal so that it can assure a sealing engagement with the side frames adjacent the threshold 10. When the seal 24 is squeezed by a force moving in the horizontal direction compressing the seal 24 against rear wall 29, the vertical height of the seal 24 increases, thereby providing an adjustability to the threshold 10.

In order to accomplish such a compression, the compression mechanism 26 is provided inside the hollow rigid assembly 22. This compression mechanism 26 is comprised of an elongated U-shaped channel member 42, a plurality of threaded rods 44 and a plurality of internally threaded cylinders 46 receiving the threaded rods therein. The channel member 42 has a vertically oriented, channel base or main portion 48, a horizontal top leg portion 50 and a horizontal bottom leg portion 52, the top leg portion 50 being adjacent the bottom of top wall 32 of the hollow assembly 22 and the bottom leg portion 52 being adjacent to and in contacting relationship with the top of bottom wall 31, along which it moves.

Each of the internally threaded cylinders 46 has an integrally formed enlarged annular flange 54 welded to the base portion 48 of channel member 42. The outer diameter of the annular flange 54 is substantially equal to the distance between leg portions 50 and 52. There are a plurality of these cylinders 46, one each threadably receiving a threaded rod 44.

Each of the threaded rods, which act as adjusting screws for the compression mechanism, has an enlarged annular flange 56 rigidly coupled thereto near the head and in contact with the inside of front wall 28, the head or distal end of each threaded rod 44 extending into and partially through one of the apertures 38 in the front wall 28. Preferably, each of the threaded rods has a slot 58 at the distal end, as seen in FIG. 2, for the reception of a screw driver.

Preferably, these threaded rods 44 and the associated cylinders 46, as well as the associated apertures 38 in front wall 28, are evenly spaced along the longitudinal extent of threshold 10. Thus, for a threshold measuring about 36 inches in longitudinal length, there will be three or four sets of cylinders, rods and apertures.

Operation

As seen in FIG. 1, the seal 24 is interposed between the channel member 42 and the rear wall 29, which in conjunction with slot 33 and a portion of bottom wall 31 form a recess 60 for reception of the seal.

Since the top leg portion 50 of channel member 42 is adjacent the bottom of top wall 32, the slot 33 remains closed in conjunction with seal 24 so that contamination does not readily enter the hollow assembly 22.

As is clear from FIG. 1, the channel member 42 is movable through the inside of hollow assembly 22 upon rotation of the threaded rods 44. In order to compress the seal 24 and therefore increase the vertical extent of the seal, rods 44 are rotated so that channel member 42 moves towards the rear wall 29. Since the lateral dimension of the hollow assembly 22 between the front wall 28 and the rear wall 29 is fixed, pressure can be applied against the seal by moving the channel member 42 towards the rear wall 29. In particular, the front wall 28 acts as a first stationary member, and with the enlarged flanges 56 on each of the threaded rods 44 being in contact therewith, rotation of threaded rods 44 pushes the cylinders 46 and the attached channel member 42 in the direction of the rear wall 29. The compression is thereby generated between the channel member 42 and the rear wall 29, which acts as a second stationary member.

Thus, a positive, firm adjustment is provided to the seal 24 so that the top portion thereof can variably protrude or extend above the top wall 32 of assembly 22 into contact with the bottom of door 12 to provide the desired weather seal. This intimate contacting does not easily deteriorate because of the threaded rods 44 and their positive urging of the channel member 42 against seal 24.

As seen in FIG. 1, a second rigid hollow assembly or extension 62 can easily be combined with the first hollow assembly 22 to increase the lateral width of the threshold 10. In particular, the second rigid assembly 62 can be snapped into recess 36 formed in assembly 22 and then firmly coupled to the floor 14 via a plurality of screws 64. As seen in FIG. 1, the rigid assembly 62 has a first portion 66 in the form of a substantially planar member which is received in slot 36 and a second substantially planar vertically oriented member 67 which is supported on the floor 14. This assembly 62 can similarly be formed from a single bent sheet of metal.

While one advantageous embodiment has been chosen to illustrate the present invention, it will be understood by those skilled in the art that various changes and modifications can be made therein without departing from the scope of the invention as defined in the appended claims.

What is claimed is:

1. A threshold having an adjustable weather seal, the combination comprising:

a rigid hollow assembly adapted to be fixedly interposed between a door and a floor;

said assembly having an elongated slot, said assembly having a first stationary member and a second stationary member spaced apart by a fixed dimension, said second stationary member defining one side of said slot;

an elongated elastomeric seal received in said slot with a portion thereof extending above said assembly; and compression means, located inside said hollow assembly and coupled to said first stationary member, for compressing said seal against said second stationary member to vary the distance said seal extends from said assembly so that said seal contacts the bottom of the door, said hollow assembly comprising a top wall extending from said first stationary member and defining the other side of said slot, said compression means comprising an elongated member having a main portion contacting said seal and a top portion extending from said main portion towards said first stationary member and below said top wall.

2. A threshold according to claim 1, wherein said compression means comprises a threaded rod.

3. A threshold according to claim 2, wherein said compression means comprises an elongated member interposed between said threaded rod and said seal.

4. A threshold according to claim 3, and further comprising an internally threaded member receiving said threaded rod and contacting said elongated member.

5. A threshold according to claim 2, wherein said threaded rod has a flange thereon, said first stationary member has an aperture therein receiving said threaded rod, said flange contacting said first stationary member.

6. A threshold according to claim 2, wherein said first stationary member has an aperture therein receiving said threaded rod.

7. A threshold according to claim 1, wherein said compression means further includes a plurality of threaded members contacting said elongated member, and a plurality of threaded rods engaging said threaded members and said first stationary member.

8. A threshold according to claim 1, wherein said hollow assembly further comprises a bottom wall, a front wall, and a rear wall, said front wall comprising said first stationary member, said rear wall comprising said second stationary member.

9. A threshold according to claim 1, wherein said hollow assembly is formed from a single sheet of metal.

10. A threshold having an adjustable weather seal, the combination comprising:

a rigid hollow assembly adapted to be fixedly interposed between a door and a floor;

said assembly having an elongated slot, said assembly having a first stationary member and a second stationary member spaced apart by a fixed dimension, said second stationary member defining one side of said slot;

an elongated elastomeric seal received in said slot with a portion thereof extending above said assembly; and compression means, located inside said hollow assembly and coupled to said first stationary member, for compressing said seal against said second stationary member to vary the distance said seal extends from said assembly so that said seal contacts the bottom of the door, said hollow assembly comprising a top wall and a bottom wall, said compression means comprising an elongated U-shaped channel member having a main portion and two leg portions, one of said leg portions being adjacent said top wall, the other of said leg portions being adjacent said bottom wall.

11. A threshold according to claim 10, wherein said other of said leg portions is in contact with and is movable along said bottom wall.

12. A threshold according to claim 1, wherein said seal is tubular.

13. A threshold according to claim 12, wherein said tubular seal has foamed polymeric material therein.

14. A threshold having an adjustable weather seal, the combination comprising:

a rigid hollow assembly adapted to be fixedly interposed between a door and the floor;

said assembly having a top wall, a front wall and a rear wall;

said top and rear walls being spaced to define a slot therebetween;

said front and rear walls being spaced apart by a fixed dimension;

an elongated elastomeric seal received in said slot with a portion thereof extending above said assembly; and compression means, located inside said hollow assembly, for compressing said seal against said rear wall to vary the distance said seal extends from said assembly so that said seal contacts the bottom of the door, said compression means comprising an elongated member in contact with said seal, and means, coupled to said elongated member and coupled to and extending from said front wall, for moving said elongated member towards said rear wall.

15. A threshold having an adjustable weather seal, the combination comprising:

a rigid hollow assembly adapted to be fixedly interposed between a door and the floor;

said assembly having a top wall, a front wall and a rear wall;

said top and rear walls being spaced to define a slot therebetween;

said front and rear walls being spaced apart by a fixed dimension;

an elongated elastomeric seal received in said slot with a portion thereof extending above said assembly;

compression means, located inside said hollow assembly, for compressing said seal against said rear wall to vary the distance said seal extends from said assembly so that said seal contacts the bottom of the door;

a flange extending from said rear wall and having a slot formed therein, and a second rigid hollow assembly having a portion received in said slot and another portion supported on the floor.

16. A threshold according to claim 14, wherein said top wall overlies at least a portion of said means for moving and at least a portion of said elongated member.

17. A threshold according to claim 14, wherein said means for moving said elongated member towards said rear wall comprises a threaded rod.

* * * * *